US008884192B2

(12) United States Patent
Shimura

(10) Patent No.: US 8,884,192 B2
(45) Date of Patent: Nov. 11, 2014

(54) HEATER AND IMAGE HEATING APPARATUS HAVING THE HEATER INSTALLED THEREIN

(71) Applicant: Canon Kabushiki Kaisha, Tokyo (JP)

(72) Inventor: Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/143,147

(22) Filed: Dec. 30, 2013

(65) Prior Publication Data

US 2014/0110394 A1 Apr. 24, 2014

Related U.S. Application Data

(63) Continuation of application No. 13/501,397, filed as application No. PCT/JP2010/072721 on Dec. 10, 2010, now Pat. No. 8,642,927.

(30) Foreign Application Priority Data

Dec. 21, 2009 (JP) ..... 2009-289723

(51) Int. Cl.

| | |
|---|---|
| ***G03G 15/20*** | (2006.01) |
| ***H05B 3/03*** | (2006.01) |
| ***H05B 3/10*** | (2006.01) |
| ***H05B 3/00*** | (2006.01) |
| ***H05B 1/02*** | (2006.01) |

(52) U.S. Cl.

CPC ..... *H05B 1/0241* (2013.01); *H05B 3/0095* (2013.01); *G03G 2215/2035* (2013.01); *G03G 15/2082* (2013.01)

USPC ..... 219/216; 219/539; 219/541; 399/329

(58) Field of Classification Search

None

See application file for complete search history.

(56) References Cited

U.S. PATENT DOCUMENTS

| | | | |
|---|---|---|---|
| 5,495,275 | A | 2/1996 | Martinengo |
| 5,640,231 | A | 6/1997 | Mitsui et al. |

(Continued)

FOREIGN PATENT DOCUMENTS

| | | | |
|---|---|---|---|
| EP | 0586063 | A | 3/1994 |
| JP | 2005-209493 | A | 8/2005 |
| JP | 2007-025474 | A | 2/2007 |

OTHER PUBLICATIONS

International Preliminary Report on Patentability and Written Opinion of the International Searching Authority dated Jul. 23, 2012, in counterpart International Application No. PCT/2010/072721.

(Continued)

*Primary Examiner* — Joseph M Pelham

(74) *Attorney, Agent, or Firm* — Fitzpatrick, Cella, Harper & Scinto

(57) ABSTRACT

The image heating apparatus includes first and second lines having a first and second heat generation blocks, the first and second lines being disposed at different positions in a transverse direction, wherein the first and second lines are arranged so that a whole of first heat generation block in the first line and a whole of second heat generation block in the second line overlap with each other in the longitudinal direction, and a whole of second heat generation block in the first line and a whole of first heat generation block in the second line overlap with each other in the longitudinal direction. By the virtue of the present invention, it achieves to be capable of suppressing a temperature rise in a non-sheet feeding area in a case of printing a sheet smaller in size than a maximum size supported by the image heating apparatus.

22 Claims, 6 Drawing Sheets

(56) References Cited

U.S. PATENT DOCUMENTS

| | | | | |
|---|---|---|---|---|
| 6,096,995 | A | 8/2000 | Toyota et al. | |
| 6,456,819 | B1 | 9/2002 | Abe et al. | |
| 7,536,124 | B2 * | 5/2009 | Yoshimoto | 399/33 |
| 7,630,662 | B2 | 12/2009 | Namiki et al. | |
| 2009/0230114 | A1 | 9/2009 | Taniguchi et al. | |
| 2010/0310267 | A1 | 12/2010 | Shimura et al. | |
| 2011/0280596 | A1 | 11/2011 | Shimura | |
| 2011/0280597 | A1 | 11/2011 | Shimura et al. | |
| 2012/0000897 | A1 | 1/2012 | Shimura | |
| 2012/0121306 | A1 | 5/2012 | Shimura et al. | |
| 2012/0201581 | A1 | 8/2012 | Shimura | |
| 2012/0201582 | A1 | 8/2012 | Shimura et al. | |

OTHER PUBLICATIONS

Chinese Office Action dated Jun. 13, 2014, issued in counterpart Chinese Application No. 201080057371.3, and English-language translation thereof.

* cited by examiner

| | HEAT GENERATION PATTERN | | | | UNIT |
|---|---|---|---|---|---|
| | 1 | 2 | 3 | 4 | |
| a (LINE LENGTH) | 3.61 | 3.61 | 3.61 | 3.61 | mm |
| b (LINE WIDTH) | 0.73 | 0.78 | 0.78 | 0.73 | mm |
| c (INTERVAL) | 3.24 | 3.24 | 3.24 | 3.24 | mm |
| RESISTIVITY | 1.25 | 1.17 | 1.17 | 1.25 | Ω |

| | HEAT GENERATION PATTERN | | | | UNIT |
|---|---|---|---|---|---|
| | 1 | 2 | 3 | 4 | |
| a (LINE LENGTH) | 3.61 | 3.61 | 3.61 | 3.61 | mm |
| b (LINE WIDTH) | 0.73 | 0.78 | 0.78 | 0.73 | mm |
| c (INTERVAL) | 3.24 | 3.24 | 3.24 | 3.24 | mm |
| RESISTIVITY | 1.25 | 1.17 | 1.17 | 1.25 | Ω |

HEATER AND IMAGE HEATING APPARATUS HAVING THE HEATER INSTALLED THEREIN

This is a continuation of U.S. patent application Ser. No. 13/501,397, filed Apr. 11, 2012, pending, which claims the benefit of International Application No. PCT/JP2010/072721, filed on Dec. 10, 2010.

TECHNICAL FIELD

The present invention relates to a heater that can be suitably applied to a heat fixing apparatus to be installed in an image forming apparatus such as an electrophotographic copying machine or an electrophotographic printer, and an image heating apparatus having the heater installed therein.

BACKGROUND ART

There are known fixing apparatus to be installed in a copying machine or a printer, including an endless belt, a ceramics heater that is in contact with an inner surface of the endless belt, and a pressure roller for forming a fixing nip portion together with the ceramic heater via the endless belt. When small size sheets are successively printed in an image forming apparatus having such a fixing apparatus installed therein, there occurs a phenomenon (temperature rise in a non-sheet feeding portion) in which a temperature gradually increases in an area having no sheet to pass therethrough, in a longitudinal direction of the fixing nip portion. If the temperature in the non-sheet feeding portion is increased to be too high, each part in the apparatus may be damaged. Further, when a large size sheet is printed under a state in which a temperature rise is caused in the non-sheet feeding portion, a hot offset of toner may occur in an area corresponding to the non-sheet feeding portion for a small size sheet.

As a method of suppressing the temperature rise in the non-sheet feeding portion, there is conceived a method in which heat generation resistors on the ceramic substrate are each made of a material having a positive resistivity-temperature characteristic and two conductive members are disposed on both ends of the substrate in the transverse direction of the substrate so that current flows through in the transverse direction (recording sheet conveyance direction) of the heater with respect to the heat generation resistors. The method is based on an idea that, when the temperature in the non-sheet feeding portion rises, the resistivity of each of the heat generation resistors in the non-sheet feeding portion is increased so as to suppress current flowing through the heat generation resistors in the non-sheet feeding portion, to thereby suppress heat generation in the non-sheet feeding portion. The positive resistivity-temperature characteristic refers to a characteristic that the resistivity increases along the increase in temperature, which is hereinafter referred to as positive temperature coefficient (PTC).

However, a material having PTC is significantly low in volume resistance, and hence it is extraordinary difficult to set the total resistance of the heat generation resistors in one heater to fall within a range for use at commercial power. In view of this, PTL 1 discloses the following configuration. That is, the heat generation resistors of PTC to be formed on the ceramic substrate are divided into multiple heat generation blocks in a longitudinal direction of the heater, and, in each heat generation block, two conductive members are disposed on both ends of the substrate in the transverse direction so as to allow current to flow in the transverse direction (recording sheet conveyance direction) of the heater. Further, the multiple heat generation blocks are electrically connected to one another in series. PTL 1 further discloses that the multiple heat generation resistors are electrically connected in parallel to one another between the two conductive members, to thereby form each of the heat generation blocks.

CITATION LIST

Patent Literature

PTL 1: Japanese Patent Application Laid-Open No. 2005-209493

SUMMARY OF INVENTION

Technical Problems

However, it is found that the conductive member is not zero in resistivity, and hence non-uniformity in heat generation distribution in the longitudinal direction of the heater cannot be suppressed unless consideration is given to the influence of heat generated in the conductive member.

Solution to Problems

In order to solve the above-mentioned problems, there is provided a heater according to the present invention, which includes: a substrate; a first conductive member provided on the substrate along a longitudinal direction of the substrate; a second conductive member provided on the substrate along the longitudinal direction at a different position from the first conductive member in a transverse direction of the substrate; multiple heat generation resistors each having a positive resistivity-temperature characteristic, which are electrically connected in parallel to one another between the first conductive member and the second conductive member; and multiple heat generation blocks including the multiple heat generation resistors electrically connected in parallel to one another, the multiple heat generation blocks being arranged along the longitudinal direction and electrically connected to one another in series, in which: the multiple heat generation resistors are diagonally arranged with respect to the longitudinal direction and to the transverse direction; the multiple heat generation blocks include first heat generation blocks in which, in the longitudinal direction, current flowing through the first conductive member and the second conductive member is in the same direction as current flowing through the multiple heat generation resistors, and second heat generation blocks in which, in the longitudinal direction, current flowing through the first conductive member and the second conductive member is in an opposite direction with respect to current flowing through the multiple heat generation resistors; the first heat generation blocks and the second heat generation blocks being connected side-by-side to one another in series in the longitudinal direction; the first heat generation blocks and the second heat generation blocks are both included in a first line and a second line, the first line and the second line being disposed at different positions in the transverse direction; and the first line and the second line are arranged in such a manner that one as a whole of the first heat generation blocks in the first line and one as a whole of the second heat generation blocks in the second line overlap each other in the longitudinal direction, and one as a whole of the second heat generation blocks in the first line and one as a whole of the first heat generation blocks in the second line overlap each other in the longitudinal direction.

Advantageous Effects of Invention

According to the present invention, the heat generation distribution is prevented from becoming non-uniform in the longitudinal direction of the heater.

DESCRIPTION OF EMBODIMENTS

Figure 1:
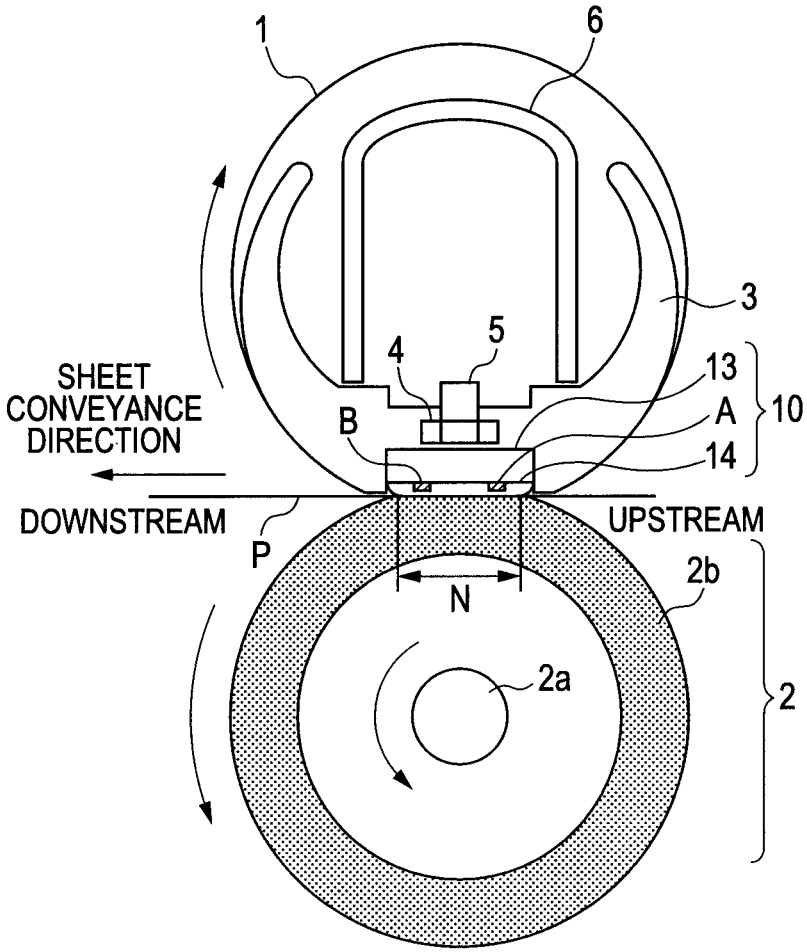
FIG. 1 is a sectional view of an image heating apparatus according to the present invention.

FIG. 1 is a sectional view of a fixing apparatus as an example of an image heating apparatus. The fixing apparatus includes a film (endless belt) 1 rolled in a cylindrical shape, a heater 10 that is in contact with an inner surface of the film 1, and a pressure roller (nip portion forming member) 2. The pressure roller 2 and the heater 10 together form a fixing nip portion N through the film 1. The film 1 has a base layer made of a heat-resistant resin such as a polyimide or a metal such as stainless. The pressure roller 2 includes a core metal 2*a* made of iron, aluminum, or the like and an elastic layer 2*b* made of silicone rubber or the like. The heater 10 is held by a retentioning member 3 made of a heat-resistant resin. The retentioning member 3 also has a guide function of guiding the rotation of the film 1. The pressure roller 2 is powered by a motor (not shown) and rotated in a direction of arrow. Along with the rotation of the pressure roller 2, the film 1 is rotated accompanying the rotation of the pressure roller 2.

The heater 10 includes a heater substrate 13 made of ceramics, a heat generation line A (first line) and a heat generation line B (second line) formed on the heater substrate 13, and a surface protective layer 14 made of an insulating material (glass in this embodiment) covering the heat generation line A and the heat generation line B. The heater substrate 13 has a back surface formed as a sheet feeding area for passing a minimum size sheet (envelop DL size, which is 110 mm in width in this embodiment) set as usable in a printer. A temperature detecting element 4 such as a thermistor abuts against the sheet feeding area. According to the temperature detected by the temperature detecting element 4, power to be supplied from a commercial alternating current power supply to the heat generation lines is controlled. A recording material (sheet) P for bearing an unfixed toner image is subjected to fixing processing in the fixing nip portion N, in which the recording material P is pinched and conveyed while being heated. Further, a safety element 5 such as a thermo-switch, also abuts against the back surface side of the heater substrate 13. The safety element 5 is actuated when the heater 10 experiences an abnormal temperature rise, and interrupts a power feed line to the heat generation lines. Similarly to the temperature detecting element 4, the safety element 5 also abuts against the sheet feeding area for the minimum size sheet. A metal stay 6 is employed for applying a spring pressure (not shown) to the retentioning member 3.

The fixing apparatus according to this embodiment is to be installed in a printer supporting A4 size (of approximately 210 mm×297 mm), which also supports a letter size (of approximately 216 mm×279 mm). In other words, the fixing apparatus is to be installed in a printer for basically conveying an A4 size sheet in portrait orientation (conveying the sheet so that the long side of the sheet is in parallel with the conveyance direction). However, the fixing apparatus is designed to be capable of conveying a letter size sheet, which is slightly larger in width than an A4 size sheet, in portrait orientation. Accordingly, the letter size is a maximum size (largest in width) of the standard sizes of recording materials (supportable sheet sizes in a catalog) to be supported by the apparatus.

First Embodiment

Figure 2A:
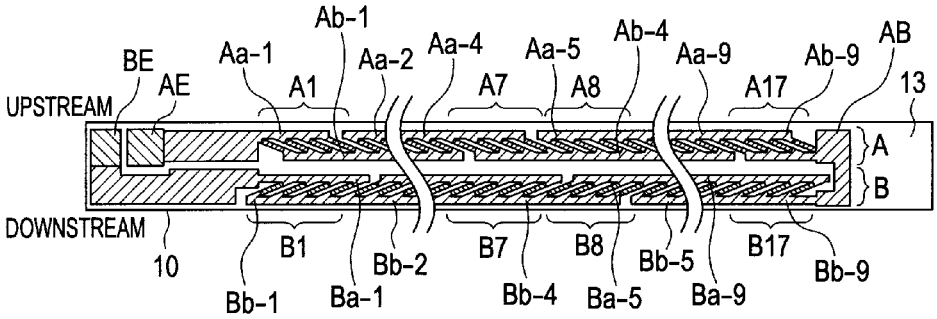
FIGS. 2A, 2B and 2C each are configuration diagrams of a heater according to a first embodiment.
Figure 2B:
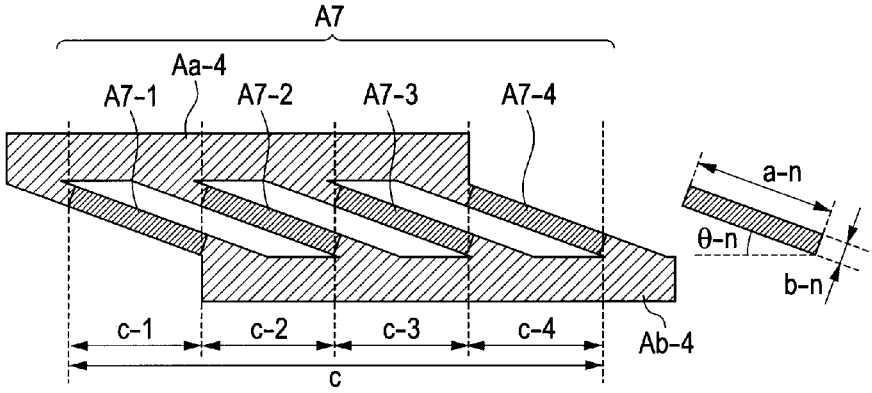
Figure 2C:
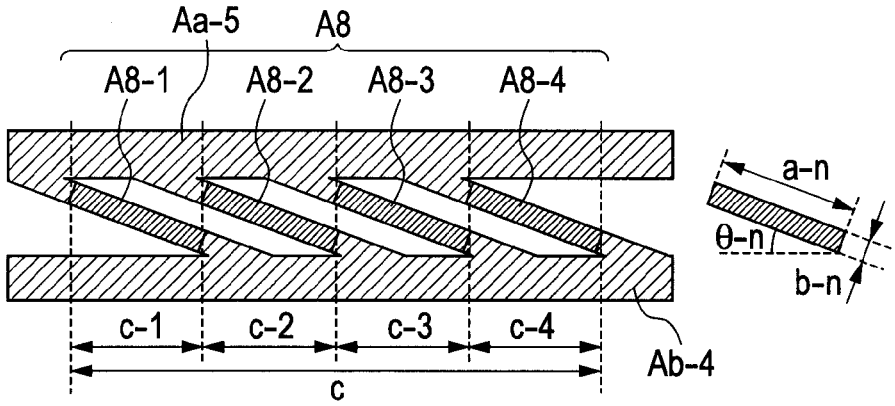

FIGS. 2A to 2C are views for illustrating a configuration of the heater 10. FIG. 2A is a plan view of the heater 10, FIG. 2B is an enlarged view illustrating a heat generation block A7 of heat generation blocks in the heat generation line A, and FIG. 2C is an enlarged view illustrating a heat generation block A8 of heat generation blocks in the heat generation line A. Note that, a heat generation resistor in the heat generation line A and a heat generation resistor in the heat generation line B both have PTC.

The heat generation line A (first line) includes seventeen heat generation blocks A1 to A17, and the heat generation blocks A1 to A17 are connected in series. The heat generation line B (second line) also includes seventeen heat generation blocks B1 to B17, and the heat generation blocks B1 to B17 are also connected in series. Further, the heat generation line A and the heat generation line B are also electrically connected in series through a conductive pattern AB. The heat generation line A and the heat generation line B are supplied with power from an electrode AE and an electrode BE connecting a power feed connector, respectively. The heat generation line A includes a conductive pattern Aa (first conductive member of the heat generation line A) and a conductive pattern Ab (second conductive member of the heat generation line A). The conductive pattern Aa and the conductive pattern Ab are both formed in a longitudinal direction of the substrate, but different from each other in position in a transverse direction of the substrate. The conductive pattern Aa is divided into nine lines (Aa-1 to Aa-9) in the longitudinal direction of the substrate. The conductive pattern Ab is divided into nine lines (Ab-1 to Ab-9) in the longitudinal direction of the substrate. As illustrated in FIG. 2B, multiple (four in this embodiment) heat generation resistors (A7-1 to A7-4) are electrically connected in parallel between the conductive pattern Aa-4 as part of the conductive pattern Aa and the conductive pattern Ab-4 as part of the conductive pattern Ab, to thereby form the heat generation block A7. Further, four heat generation resistors (A8-1 to A8-4) are electrically connected in parallel between the conductive pattern Ab-4 and the conductive pattern Aa-5, to thereby form the heat generation block A8. The heat generation line A includes seventeen heat generation blocks (A1 to A17) in total, which are configured similarly to the heat generation block A7 or A8.

The heat generation line B similarly includes a conductive pattern Ba (first conductive member of the heat generation line B) and a conductive pattern Bb (second conductive member of the heat generation line B). The conductive pattern Ba and the conductive pattern Bb are both formed in the longitudinal direction of the substrate, but different from each other in position in the transverse direction of the substrate. The heat generation line B also includes heat generation blocks which are configured similarly to those in the heat generation line A.

Further, as illustrated in FIGS. 2B and 2C, in each of the heat generation blocks, the multiple heat generation resistors are arranged diagonally with respect to both the longitudinal direction of the substrate and the transverse direction (recording material conveyance direction) of the substrate so that the multiple heat generation resistors next to each other have a positional relation that allows shortest current paths formed therebetween to overlap each other in the longitudinal direction of the substrate (heat generation resistors next to each other are arranged so as to partially overlap each other in the longitudinal direction of the substrate). The same positional relation is established between a heat generation resistor on the farthest end in one of the heat generation blocks (for example, the heat generation resistor A7-4 on the rightmost side in the heat generation block A7) and another heat generation register on the farthest end in another one of the heat generation blocks next to the one of the heat generation blocks (for example, the heat generation resistor A8-1 on the leftmost side in the heat generation block A8). In this embodiment, the heat generation resistors are rectangular in shape, and hence an entire area of each heat generation resistor serves as the shortest current path. In this embodiment, as illustrated in FIGS. 2B and 2C, the heat generation resistors are aligned so that a center of a short side of the rectangular shape of one of the heat generation resistors overlaps a center of a short side of the rectangular shape of another one of the heat generation resistors next to the one of the heat generation registers, in the longitudinal direction of the substrate. The above-mentioned layout of the heat generation resistors is capable of preventing the generation of an area in which the heat generation resistor does not generate heat in the longitudinal direction of the heater, to thereby suppress non-uniformity in heat generation distribution.

Meanwhile, as described above, the conductive member is not zero in resistivity, and the resistivity thereof is influenced by a resistive component of the conductive member. It is found that, in one heat generation block, the heat generation resistor in the center is applied with a voltage smaller than that applied to the heat generation resistors on both end portions. The heat generation amount of the heat generation resistor is proportional to the square of the applied voltage, and hence the heat generation amount in one heat generation block varies between the center and the both end portions thereof. Specifically, in one heat generation block, the heat generation amount becomes largest in both end portions of the block while the heat generation amount is reduced in the center of the block. In view of this, in this embodiment, the multiple heat generation resistors included in each of the heat generation blocks are each adjusted in resistivity so that the heat generation resistors arranged at end portions are higher in resistivity than the heat generation resistor arranged in the center in the longitudinal direction (see FIGS. 2B and 2C). In the heater according to this embodiment, the heater 10 includes the heat generation resistors (A7-1 to A7-4) of the heat generation block A7 and the heat generation resistors (A8-1 to A8-4) of the heat generation block A8, in which the heat generation resistors (A7-2, A7-3, A8-2, A8-3) in the center are reduced in resistivity as becoming closer to the center while the heat generation resistors (A7-1, A7-4, A8-1, A8-4) are increased in resistivity as becoming closer to the end portion, to thereby improve uniformity in heat generation distribution in one heat generation block.

Further, the conductive member is not zero in resistivity, and hence the resistivity thereof is influenced by heat generated in the conductive member. When the multiple heat generation resistors are arranged diagonally with respect to both the longitudinal direction of the substrate and the transverse direction of the substrate so as not to generate an area in which the heat generation resistor does not generate heat in the longitudinal direction of the heater as described above, it is found that the heat generation block illustrated in FIG. 2B and the heat generation block illustrated in FIG. 2C become different from each other in heat generation amount. This phenomenon is described with reference to FIGS. 3A to 3C.

Figure 3A:
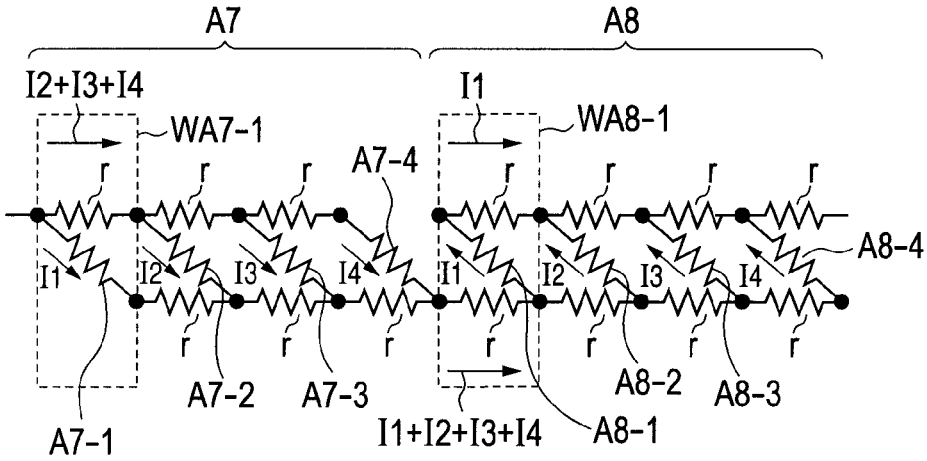
FIGS. 3A, 3B and 3C each are explanatory diagrams of a heat generation distribution in the heater according to the first embodiment.
Figure 3B:
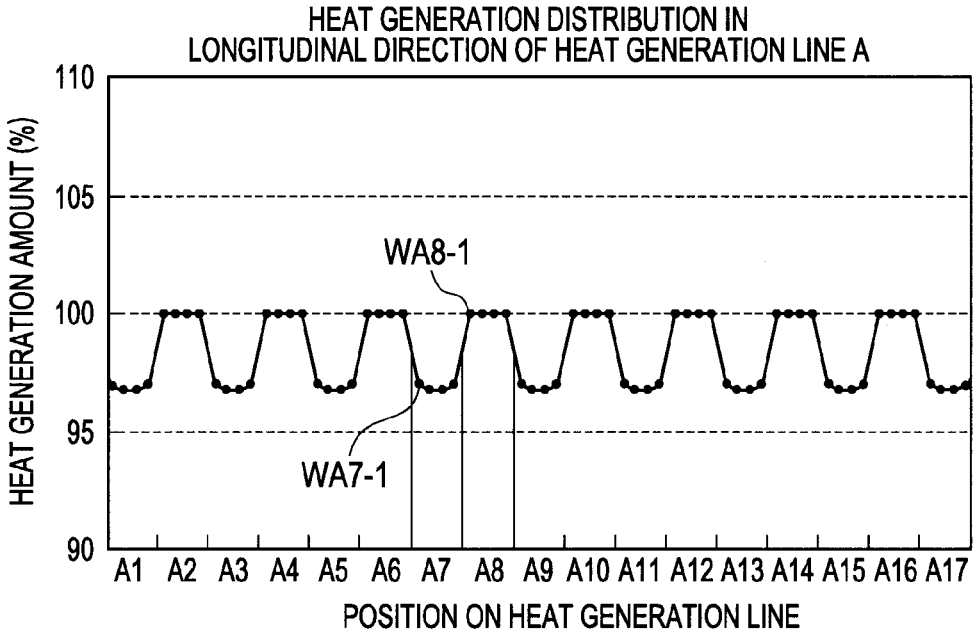
Figure 3C:
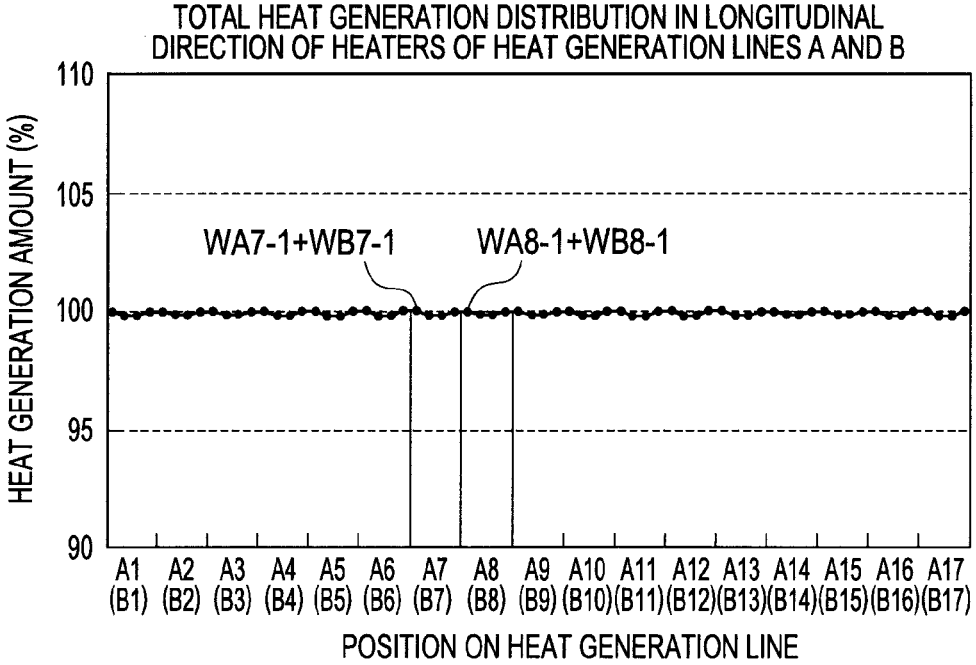

FIG. 3A is an equivalent circuit diagram of the heat generation blocks A7 and A8 in the heat generation line A. FIG. 3B is a graph illustrating the heat generation distribution in the heat generation line A. FIG. 3C is a graph illustrating a heat generation distribution of a sum of heat generated in both the heat generation line A and the heat generation line B. As illustrated in FIG. 3A, when the multiple heat generation resistors are diagonally arranged with respect to the longitudinal direction and transverse direction of the substrate, a first heat generation block (heat generation block A7) and a second heat generation block (heat generation block A8) are formed. In the first heat generation block, currents flowing through the first and second conductive members are in the same direction as currents flowing through the heat generation resistors in the longitudinal direction. In the second heat generation block, currents flowing through the first and second conductive members are in the opposite direction as currents flowing through the heat generation resistors in the longitudinal direction. Further, the first heat generation block (heat generation block A7) and the second heat generation block (heat generation block A8) are connected side-by-side to each other in series in the longitudinal direction.

As illustrated in the equivalent circuit diagram of the heat generation blocks A7 and A8 of FIG. 3A, the heat generation resistors (A7-1 to A7-4) and the heat generation resistors (A8-1 to A8-4) are connected in parallel via the conductive pattern. When the resistivity of the conductive pattern is r, the heat generation amount of the conductive pattern in an area WA7-1, in which the heat generation resistor A7-1 of the heat generation block A7 is disposed, is obtained as a product ($=r\times(I2+I3+I4)^2$) of the resistivity of the conductive pattern Aa-4 and the square of a current value flowing through the conductive pattern Aa-4. The heat generation amount of the conductive pattern in an area WA8-1, in which the heat generation resistor A8-1 in the heat generation block A8 is disposed, is obtained as a sum of a product ($=r\times I1^2$) of the resistivity of the conductive pattern Aa-5 and the square of a current value flowing through the conductive pattern Aa-5 and a product ($=r\times(I1+I2+I3+I4)^2$) of the resistivity of the conductive pattern Ab-4 and the square of a current value flowing through the conductive pattern Ab-4. In the heat generation block A8, when a current flows in one direction along the longitudinal direction of the heater, the heat generation block A8 has a return path for a current to flow in an opposite direction, and hence it turns out that the heat generation amount of the heat generation block A8 due to the conductive pattern is increased correspondingly due to the return path, as compared with the heat generation block A7. Similarly, the conductive pattern in an area in which the heat generation resistors A8-2 to A8-4 of the heat generation block A8 are disposed is increased in heat generation amount as compared with the heat generation amount of the conductive pattern in an area in which the heat generation resistors A7-2 to A7-4 of the heat generation block A7 are disposed. In the heat generation line A, the conductive pattern in the heat generation blocks A2, A4, A6, A8, A10, A12, A14, and A16 has a larger heat generation amount as compared with the heat generation amount of the conductive pattern in the heat generation blocks A1, A3, A5, A7, A9, A11, A13, A15, and A17. In the heat generation line B, the conductive pattern in the heat generation blocks B1, B3, B5, B7, B9, B11, B13, B15, and B17 has a larger heat generation amount as compared with the heat generation amount of the conductive pattern in the heat generation blocks B2, B4, B6, B8, B10, B12, B14, and B16. In the heater 10, the heat generation blocks (first heat generation blocks) in which the heat generation amount of the conductive pattern is small and the heat generation blocks (second heat generation blocks) in which the heat generation amount of the conductive pattern is large are alternately connected. Note that, in simulations based on FIGS. 3B and 3C, calculation is made assuming that the total resistivity of the heat generation resistors in the heater 10 is about 11.5Ω, the sheet resistivity of the conductive pattern is 0.005Ω/□, and the sheet resistivity of the heat generation resistors is 0.25Ω/□. Under a simplified condition that the heat generation resistors lying side-by-side in the heat generation block are connected to each other at both end portions thereof via the conductive pattern having a line length of 3.24 mm and a line width of 0.8 mm, the resistivity r of the conductive pattern connecting the heat generation resistors is obtained as 0.02Ω.

FIG. 3B is a heat generation distribution chart of the heat generation line A including the heat generation amount of the conductive pattern. As described above, in the heat generation line A, the heat generation blocks in which the heat generation amount of the conductive pattern is small and the heat generation blocks in which the heat generation amount of the conductive pattern is large are alternately connected, and hence it is found that the heat generation distribution becomes non-uniform in the longitudinal direction of the heater.

In view of the above, in the heater according to this embodiment, as illustrated in FIG. 2A, the first line and the second line each having both the first heat generation blocks and the second heat generation blocks are arranged at different positions in the transverse direction. Then, the first line and the second line are arranged so that one first heat generation block as a whole in the first line and one second heat generation block as a whole in the second line are substantially overlap each other in the longitudinal direction, and one second heat generation block as a whole in the first line and one first heat generation block as a whole in the second line are substantially overlap each other in the longitudinal direction. With this configuration, the heat generation blocks (second heat generation blocks) in which the heat generation amount of the conductive pattern is large in the first heat generation line A (first line) and the heat generation blocks (first heat generation blocks) in which the heat generation amount of the conductive pattern is small in the heat generation line B (second line) overlap each other in the longitudinal direction of the substrate. Further, the heat generation blocks (first heat generation blocks) in which the heat generation amount of the conductive pattern is small in the first heat generation line A (first line) and the heat generation blocks (second heat generation blocks) in which the heat generation amount of the conductive pattern is large in the heat generation line B (second line) overlap each other in the longitudinal direction of the substrate. As a result, the non-uniform heat generation distribution in the longitudinal direction of the heater due to the conductive pattern may be suppressed. Note that, the first heat generation block and the second heat generation block do not necessarily overlap each other completely without being displaced from each other by no more than 1 mm, as long as one first heat generation block as a whole and one second heat generation block as a whole are substantially overlap each other so that the heat generation distribution is prevented from becoming non-uniform. With reference to FIG. 3C, a non-uniform heat generation suppressing effect to be produced in the case of FIG. 2A is described.

FIG. 3C is a heat generation distribution chart illustrating a total heat generation distribution of the heat generation line A and the heat generation line B, including the heat generation amount of the conductive pattern. The heat generation line A on an upstream side and the heat generation line B on a downstream side cancel out the difference in the heat generation amount therebetween, and hence it is found that the uniformity in heat generation distribution in the longitudinal direction of the heater is improved.

As described above, the first line and the second line are arranged so that one first heat generation block as a whole in the first line and one second heat generation block as a whole in the second line are substantially overlap each other in the longitudinal direction and one second heat generation block as a whole in the first line and one first heat generation block as a whole in the second line are substantially overlap each other in the longitudinal direction, to thereby prevent the heat generation distribution from becoming non-uniform.

Note that, the shape of each of the heat generation resistors is not limited to the rectangular shape as illustrated in FIGS. 2A to 2C, but it is preferred in particular that each of the heat generation resistors be formed in a rectangular shape. The rectangular shape allows a current to flow through the entire heat generation resistor. For example, if the heat generation resistor is formed in a parallelogram, a shortest path along which current flows with ease is formed only in part of each heat generation resistor, rather than across an entire area of the heat generation resistor, and hence a large amount of current is concentrated to heavily flow along the shortest path. Accordingly, the current flow distribution in each heat generation resistor is biased, which may result in a reduction in the effect of suppressing non-uniform heat generation distribution. However, with the heat generation resistors formed in a rectangular shape, this phenomenon is prevented from being caused.

Figure 4:
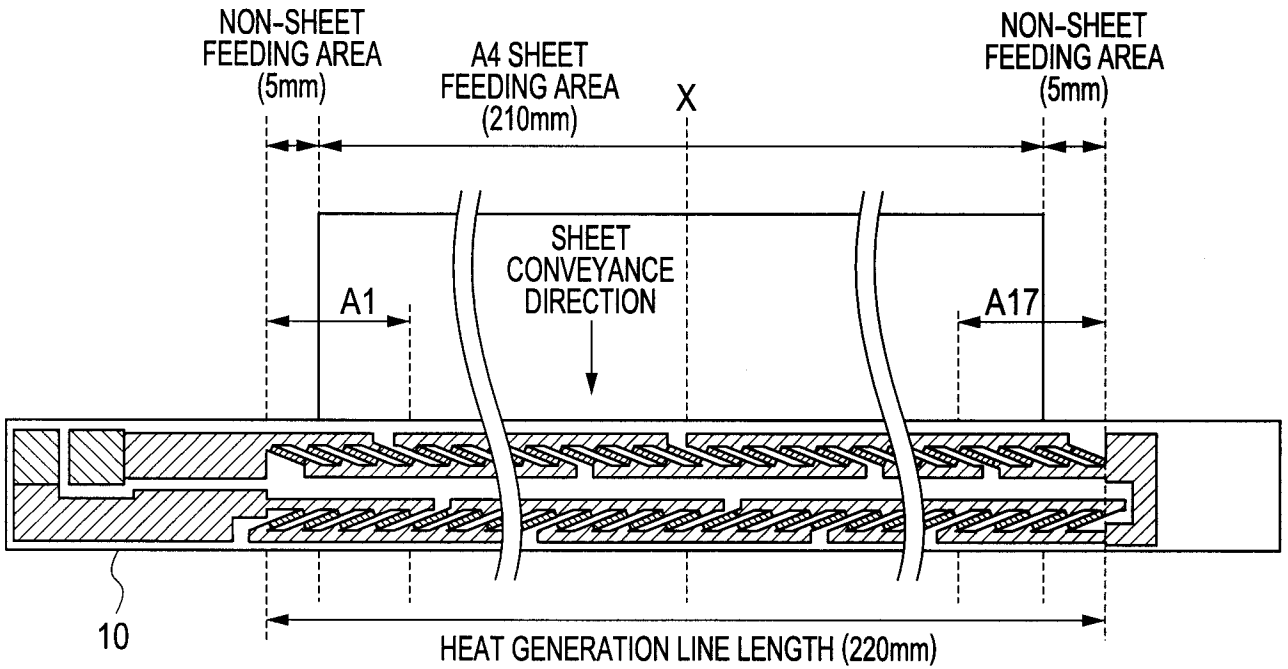
FIG. 4 is a diagram illustrating a relation between a size of the heater and a sheet size.

FIG. 4 is a view for illustrating a temperature rise in non-sheet feeding areas of the heater 10. The heater 10 is disposed in such a manner that the center of an area (heat generation line length) in which the heat generation resistors are provided in the longitudinal direction of the substrate coincides with a recording material conveyance reference X of the printer. This example illustrates, by way of example, a case of conveying an A4 size sheet (of 210 mm×297 mm) in portrait orientation (conveying the sheet so that the side of 297 mm is in parallel with the conveyance direction), and the heater 10 is installed in a printer in which a recording material is conveyed in such a manner that the center of the side of 210 mm of an A4 size sheet coincides with the reference X.

The heater 10 has a heat generation line length of 220 mm so as to support a case of conveying a US-letter size sheet (of approximately 216 mm×279 mm) in portrait orientation. Meanwhile, as described above, a printer having the fixing apparatus of this embodiment installed therein supports a letter size, but basically supports an A4 size sheet. Accordingly, the printer is intended for users who use an A4 size sheet most frequently. However, the printer also supports a letter size, and hence, in the case of performing printing on an A4 size sheet, non-sheet feeding areas of 5 mm in width are formed on both end portions of the heat generation line. During fixing processing, power supply to the heater 10 is controlled so that a temperature detected by the temperature detecting element 4 for detecting a heater temperature in the vicinity of the recording material conveyance reference X is maintained at a control target temperature. Accordingly, a temperature in the non-sheet feeding areas is increased to be higher than a temperature in a sheet feeding area because the sheet does not draw heat from the non-sheet feeding areas. Note that, in this embodiment, a letter size is defined as a maximum size, and an A4 size is defined as a specific size which requires measures to prevent a temperature rise in the non-sheet feeding areas.

The heater 10 of this embodiment is configured so that, as illustrated in FIG. 4, the end portions of an A4 size sheet pass through the heat generation blocks A1, A17, B1, and B17 disposed on both ends of the heater 10 while the end portions of the sheet do not pass through the heat generation resistors (A1-1, A1-4, A17-1, A17-4, B1-1, B1-4, B17-1, and B17-4) disposed on both ends of each of the heat generation blocks. With this configuration, despite that the heat generation resistors disposed in an area where the A4 size sheet does not pass through are increased in temperature, the heat generation resistors have PTC, and hence the heat generation resistors are increased in resistivity to resist a flow of current passing therethrough. Accordingly, heat generation is suppressed, with the result that the temperature rise in the non-sheet feeding areas is suppressed.

Further, as described above, the heater 10 is configured so as to prevent a non-uniform heat generation distribution from being generated across the longitudinal direction of the heater. Accordingly, non-uniformity in heat generation is suppressed in the area that allows a sheet to pass therethrough, and hence uniformity in fixing performance can be attained.

Second Embodiment

Figure 5:
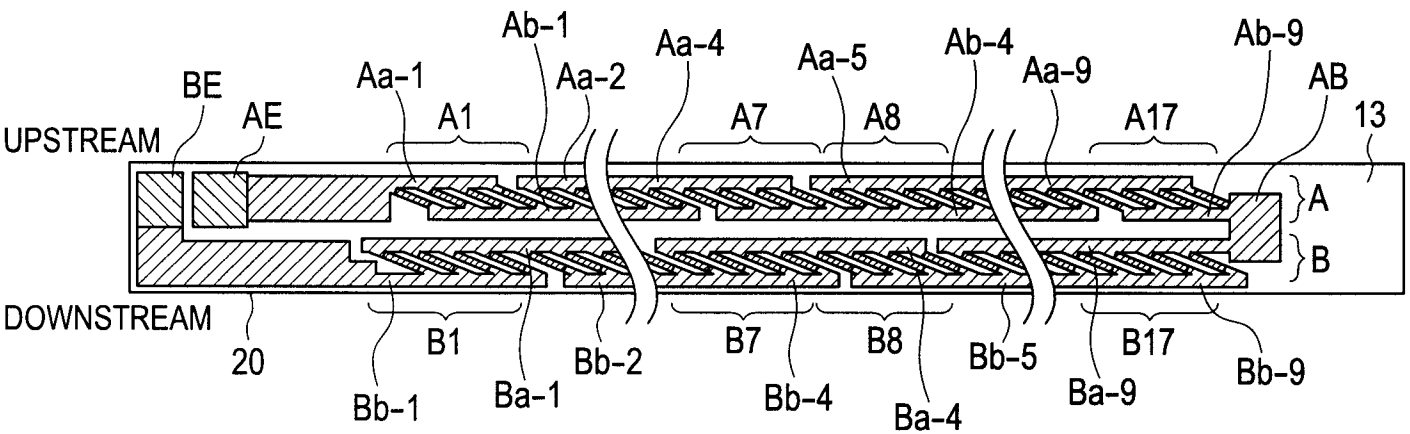
FIG. 5 is a configuration diagram of a heater according to a second embodiment.

FIG. 5 is a configuration diagram of a heater 20 according to a second embodiment. The heater 20 is different from the heater 10 of the first embodiment in that the heat generation resistors in the heat generation line A and in the heat generation resistor B are all inclined in the same direction. However, in the heater 20, the conductive patterns (Ba, Bb) in the heat generation line B are elaborated in shape. Thus, similarly to the heater 10 of the first embodiment, the first line and the second line are arranged so that one first heat generation block as a whole in the first line (heat generation line A) and one second heat generation block as a whole in the second line (heat generation line B) are substantially overlap each other in the longitudinal direction and one second heat generation block as a whole in the first line and one first heat generation block as a whole in the second line are substantially overlap each other in the longitudinal direction. Specifically, in the heat generation line A, the heat generation blocks A1, A3, A5, A7, A9, A11, A13, A15, and A17 each correspond to the first heat generation block having a small heat generation amount, while the heat generation blocks A2, A4, A6, A8, A10, A12, A14, and A16 each correspond to the second heat generation block having a large heat generation amount. In the heat generation line B, the heat generation blocks B2, B4, B6, B8, B10, B12, B14, and B16 each correspond to the first heat generation block having a small heat generation amount, while the heat generation blocks B1, B3, B5, B7, B9, B11, B13, B15, and B17 each correspond to the second heat generation block having a large heat generation amount. Further, the heat generation blocks A1 and B1, the heat generation blocks A2 and B2, . . . , and the heat generation blocks A17 and B17 are respectively overlap each other in the longitudinal direction of the substrate, to thereby suppress non-uniformity in heat generation distribution.

This application claims the benefit of Japanese Patent Application No. 2009-289723, filed Dec. 21, 2009, which is hereby incorporated by reference herein in its entirety.

REFERENCE SIGNS LIST

1 fixing film
2 pressure roller
10 heater
A heat generation line A (first line)
B heat generation line B (second line)
A1 to A17 heat generation blocks in the heat generation line A
B1 to B17 heat generation blocks in the heat generation line B
Aa, Ab conductive patterns of the heat generation line A
Ba, Bb conductive patterns of the heat generation line B
A1-1 to A17-4, B1-1 to B17-4 heat generation resistors

The invention claimed is:

1. A heater comprising:

an elongated substrate having longitudinal and lateral dimensions;

first and second heat generation lines configured to generate heat, the first and second heat generation lines being provided on the substrate along a longitudinal direction of the substrate, the first heat generation line including a first heat generation block at the end of the first heat generation line and the second heat generation line including a second heat generation block at the end of the second heat generation line; and a conductive pattern configured to electrically connect the first heat generation block and the second heat generation block, wherein each of the first and second heat generation blocks includes first and second conductive members provided on the substrate along the longitudinal direction of the substrate, and a plurality of heat generation resistors connected in parallel between the first conductive member and the second conductive member, wherein the plurality of heat generation resistors in the first and second heat generation blocks are inclined with respect to the longitudinal direction of the substrate and with respect to the lateral the direction of the substrate, and wherein the conductive pattern connects the first heat generation block with the second heat generation block so that a component in the longitudinal direction of the substrate of the direction of current flowing through the plurality of heat generation resistors in the first heat generation block is the same as a direction of current flowing through the first conductive members in the first heat generation block, and a component in the longitudinal direction of the substrate of the direction of current flowing through the plurality of the heat generation resistors in the second heat generation block is opposite to direction of current flowing through the first and second conductive members in the second heat generation block.

2. A heater according to claim 1, wherein the first and the second heat generation lines are arranged so that an entire region of the first heat generation block in the longitudinal direction of the substrate and an entire region of the second heat generation block in the longitudinal direction of the substrate are located at the same position in the longitudinal direction of the substrate.

3. A heater according to claim 1, wherein the plurality of heat generating resistors in the first and second heat generation blocks are PTC-type resistors.

4. An image heating apparatus comprising:
an endless belt;
a heater according to claim 1; and
a nip portion forming member configured to form a nip portion together with the heater via the endless belt,
wherein the heater is in contact with an inner surface of the endless belt, and
wherein the image heating apparatus heats a recording material bearing an image while pinching and conveying the recording material by the nip portion.

5. An image forming apparatus according to claim 4, wherein the first and the second heat generation lines are arranged so that an entire region of the first heat generation block in the longitudinal direction of the substrate and an entire region of the second heat generation block in the longitudinal direction of the substrate are located at the same position in the longitudinal direction of the substrate.

6. An image heating apparatus according to claim 4, wherein the plurality of heat generating resistors in the first and second heat generation blocks are PTC-type resistors.

7. A heater comprising:
an elongated substrate having longitudinal and lateral dimensions;
first and second heat generation lines configured to generate heat, the first and second heat generation lines being provided on the substrate along a longitudinal direction of the substrate, the first heat generation line including a first heat generation block at the end of the first heat generation line and the second heat generation line including a second heat generation block at the end of the second heat generation line; and
a conductive pattern configured to electrically connect the first heat generation block and the second heat generation block,
wherein each of the first and second heat generation blocks includes first and second conductive members provided on the substrate along the longitudinal direction of the substrate and a plurality of heat generation resistors connected in parallel between the first conductive member and the second conductive member,
wherein the first and second conductive members in the first heat generation block are spaced in the lateral direction of the substrate in that order, and the first and second conductive members in the second heat generation block are spaced in the lateral direction of the substrate in that order,
wherein the plurality of heat generation resistors in the first and second heat generation blocks are inclined with respect to the longitudinal direction of the substrate and with respect to the lateral direction of the substrate, and inclined directions of the plurality of the heat generation resistors in the first heat generation block are opposite to inclined directions of the plurality of the heat generation resistors in the second heat generation block, and
wherein the conductive pattern connects the first conductive member in the first heat block with the first conductive member in the second heat block, or the second conductive member in the first heat block with the second conductive member in the second heat block.

8. A heater according to claim 7, wherein with regard to a center position between the first heat generation block and the second heat generation block, the plurality of heat generation resistors in the first heat generation block is inclined to the plurality of heat generation resistors in the second heat generation block substantially in line-symmetry with each other.

9. A heater according to claim 7, wherein the first and the second heat generation lines are arranged so that an entire region of the first heat generation block in the longitudinal direction of the substrate and an entire region of the second heat generation block in the longitudinal direction of the substrate are located at the same position in the longitudinal direction of the substrate.

10. A heater according to claim 7, wherein the plurality of heat generating resistors in the first and second heat generation blocks are PTC-type resistors.

11. An image heating apparatus comprising:
an endless belt;
a heater according to claim 7; and
a nip portion forming member configured to form a nip portion together with the heater via the endless belt,
wherein the heater is in contact with an inner surface of the endless belt, and
wherein the image heating apparatus heats a recording material bearing an image while pinching and conveying the recording material by the nip portion.

12. An image heating apparatus according to claim 10, with regard to a center position between the first heat generation block and the second heat generation block, the plurality of heat generation resistors in the first heat generation block is inclined to the plurality of heat generation resistors in the second heat generation block substantially in line-symmetry with each other.

13. An image heating apparatus according to claim 10, wherein the first and the second heat generation lines are arranged so that an entire region of the first heat generation block in the longitudinal direction of the substrate and an entire region of the second heat generation block in the longitudinal direction of the substrate are located at the same position in the longitudinal direction of the substrate.

14. An image heating apparatus according to claim 10, wherein the plurality of heat generating resistors in the first and second heat generation blocks are PTC-type resistors.

15. A heater comprising:
an elongated substrate having longitudinal and lateral dimensions;
first and second heat generation lines configured to generate heat, the first and second heat generation lines being provided on the substrate along a longitudinal direction of the substrate, the first heat generation line including a first heat generation block at the end of the first heat generation line and the second heat generation line including a second heat generation block at the end of the second heat generation line; and
a conductive pattern configured to electrically connect the first heat generation block and the second heat generation block,
wherein each of the first and second heat generation blocks includes first and second conductive members provided on the substrate along the longitudinal direction of the substrate and a plurality of heat generation resistors connected in parallel between the first conductive member and the second conductive member,
wherein the first and second conductive members in the first heat generation block are spaced in the lateral direction of the substrate in that order, and the first and second conductive members in the second heat generation block are spaced in the lateral direction of the substrate in that order,
wherein the plurality of heat generation resistors in the first and second heat generation blocks inclined with respect to the longitudinal direction of the substrate and with respect to the lateral direction of the substrate, and inclined directions of the plurality of the heat generation resistors in the first heat generation block are the same as inclined directions of the plurality of the heat generation resistors in the second heat generation block, wherein the conductive pattern connects the first conductive member in the first heat generation block with the second conductive member in the second heat generation block, or the second conductive member in the first heat generation block with the first conductive member in the second heat generation block.

16. A heater according to claim 15, wherein the plurality of heat generation resistors in the first heat generation block and the plurality of heat generation resistors in the second heat generation block are inclined substantially in parallel with each other.

17. A heater according to claim 15, wherein the first and the second heat generation lines are arranged so that an entire region of the first heat generation block in the longitudinal direction of the substrate and an entire region of the second heat generation block in the longitudinal direction of the substrate are located at the same position in the longitudinal direction of the substrate.

18. A heater according to claim 15, wherein the plurality of heat generating resistors in the first and second heat generation blocks are PTC-type resistors.

19. An image heating apparatus comprising:

an endless belt;

a heater according to claim 15; and a nip portion forming member configured to form a nip portion together with the heater via the endless belt, wherein the heater is in contact with an inner surface of the endless belt, and wherein the image heating apparatus heats a recording material bearing an image while pinching and conveying the recording material by the nip portion.

20. An image heating apparatus according to claim 19, wherein the plurality of heat generation resistors in the first heat generation block and the plurality of heat generation resistors in the second heat generation block are inclined substantially in parallel with each other.

21. An image heating apparatus according to claim 19, wherein the first and the second heat generation lines are arranged so that an entire region of the first heat generation block in the longitudinal direction of the substrate and an entire region of the second heat generation block in the longitudinal direction of the substrate are located at the same position in the longitudinal direction of the substrate.

22. An image heating apparatus according to claim 19, wherein the plurality of heat generating resistors in the first and second heat generation blocks are PTC-type resistors.

* * * * *